United States Patent [19]

Krug

[11] 4,377,044

[45] Mar. 22, 1983

[54] SNOW THROWER WITH DUAL CONTROLS

[75] Inventor: Charles C. Krug, Saginaw, Tex.

[73] Assignee: K & S Industries, Inc., Saginaw, Mich.

[21] Appl. No.: 236,663

[22] Filed: Feb. 23, 1981

[51] Int. Cl.[3] ..... E01H 5/09; H01H 9/06

[52] U.S. Cl. ..... 37/245; 200/157

[58] Field of Search ..... 37/43 R, 43 A, 43 B, 37/43 C, 43 D, 43 E, 43 F, 43 G, 43 L, 43 K, 53, 245, 246, 259; 200/5 R, 18, 157; 173/170

[56] References Cited

U.S. PATENT DOCUMENTS

| | | | |
|---|---|---|---|
| 2,159,590 | 5/1939 | Huck | 200/157 |
| 3,131,277 | 4/1964 | Brenzen | 200/157 |
| 3,511,951 | 5/1970 | Miller | 200/157 |
| 3,844,360 | 10/1974 | Green et al. | 173/170 |
| 4,190,972 | 3/1980 | Berner | 37/43 D |
| 4,255,880 | 3/1981 | McMickle et al. | 37/43 B |

FOREIGN PATENT DOCUMENTS

| | | | |
|---|---|---|---|
| 2909499 | 9/1980 | Fed. Rep. of Germany | 200/157 |
| 143832 | 4/1961 | U.S.S.R. | 37/43 D |

*Primary Examiner*—E. H. Eickholt

*Attorney, Agent, or Firm*—Robert A. Felsman

[57] ABSTRACT

A manual electrically powered snow throwing device has features that allow it to be used either in a shovel mode or in a pushing and pulling mode. The device has an upper handgrip with forward and rearward handgrip portions. The forward handgrip portion is located on the same axis as that of the handle. The rearward handgrip portion extends downwardly from the forward handgrip portion. The triggers are mounted to both forward and rearward handgrip portions. These triggers are connected in parallel, so that each will independently control the motor. The forward handgrip portion is used for a shovelling motion, while the rearward handgrip portion is used for pushing and pulling motion.

1 Claim, 3 Drawing Figures

SNOW THROWER WITH DUAL CONTROLS

BACKGROUND OF THE INVENTION

This invention relates in general to bulk material moving devices, and in particular to an electrically powered snow thrower.

One type of apparatus for removing snow from sidewalks and driveways is a manually operated, electrically powered device. This type of device has a housing that contains a motor and an impeller. The electrical motor drives the impeller to draw in and discharge snow out a chute. The housing rests on the ground and is moved by the user with a long tubular handle. A handgrip and trigger is located at the upper and rearward end of the handle.

This type of device is designed to be operated by pushing and pulling the device. With each push, a few inches of snow will be removed by the device. In deep snow it would be helpful to use the device as a shovel, instead of pushing and pulling. The user grasps the handle with one hand near the housing and operates the trigger with the other hand. Then he swings the device upwardly and downwardly to remove snow. Shovelling movement would be helpful particularly for removing drifts of snow thrown onto one's driveway by a street snowplow.

While a conventional snow thrower might be used by some in a shovelling movement, this manipulation is awkward. Conventional throwers of this type have a single motor control trigger located on a portion of the upper handgrip that depends downwardly from the upper end of the shaft. This positioning enables the user to pull the trigger while he is grasping the handgrip and pushing or pulling the device. It is difficult, however, to manipulate the trigger while using the device as a shovel, since the trigger is located on a portion of the handgrip that is transverse to the handle.

U.S. Pat. No. 3,844,360, issued to Robert F. Green on Oct. 29, 1974, shows dual triggers for controlling the engine of a chain saw. One trigger is used for starting and the other for sawing operation.

SUMMARY OF THE INVENTION

The snow throwing device of this invention is constructed to allow it to be conveniently used in the pushing and pulling mode and also in the shovelling mode. The upper handgrip has forward and rearward handgrip portions. The forward handgrip portion is located on the tubular handle, with an axis that coincides with the axis of the tubular handle. This forward handgrip portion has a trigger for controlling the motor independently. The forward handgrip portion is particularly useful when using the device as a shovel.

A rearward handgrip portion depends from the forward handgrip portion. The rearward handgrip portion also has a trigger. The trigger of the rearward handgrip portion is connected in parallel with the forward trigger so that either will independently control the motor. The rearward handgrip portion is particularly useful when pushing or pulling the device.

DESCRIPTION OF THE PREFERRED EMBODIMENT

Figure 1:
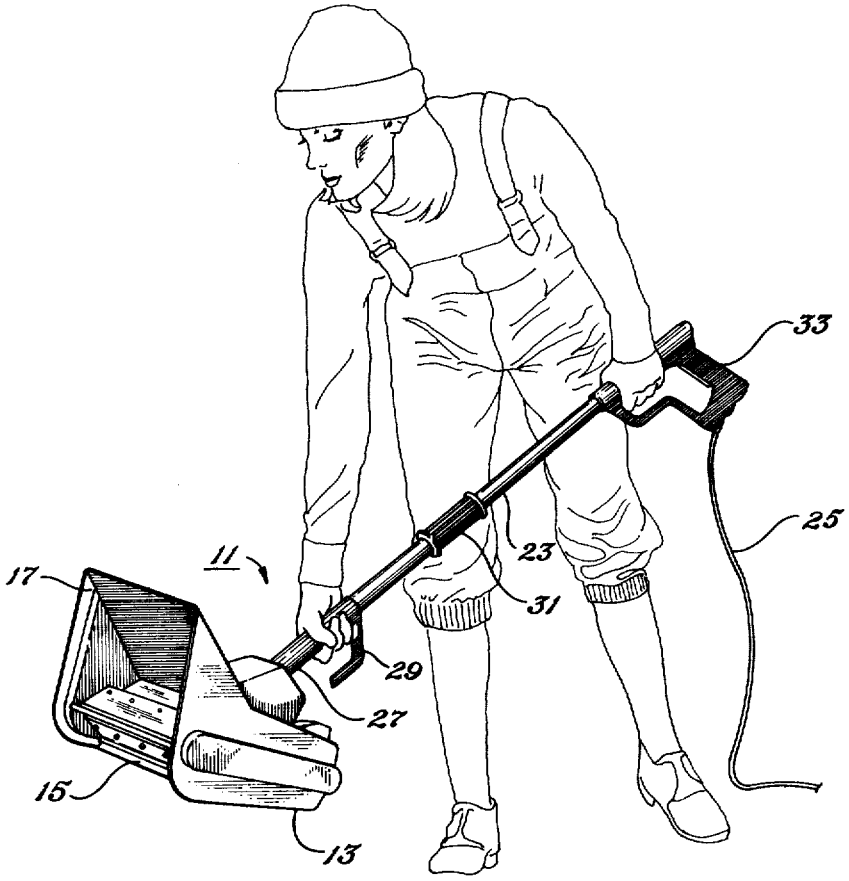
FIG. 1 is a perspective view of a snow removing device constructed in accordance with this invention, and shown being used in the shovel mode.

Referring to FIG. 1, the snow removing device 11 includes a housing 13. An impeller 15 is located inside the housing 13. Impeller 15 is rotatable about its axis, and has blades that draw bulk material such as snow in and throw it forwardly out through chute 17 of housing 13. A motor (not shown) is located in housing 13 for rotating impeller 15.

A tubular handle 23 extends upwardly and rearwardly from the top of housing 13. Handle 23 is used to manipulate housing 13, and also serves as a conduit for electrical wire 25 for powering the motor. A lower handgrip 27 is formed around handle 23 at its junction with housing 13. Handgrip 27 includes a molded plastic cylinder that receives handle 23. A hook 29 extends downwardly from handgrip 27 for wrapping coils of electrical extension cord, when not in use. An intermediate handgrip means 31 is located at about the center of handle 23. Handgrip 31 is a molded plastic cylinder through which handle 23 passes.

Figure 2:
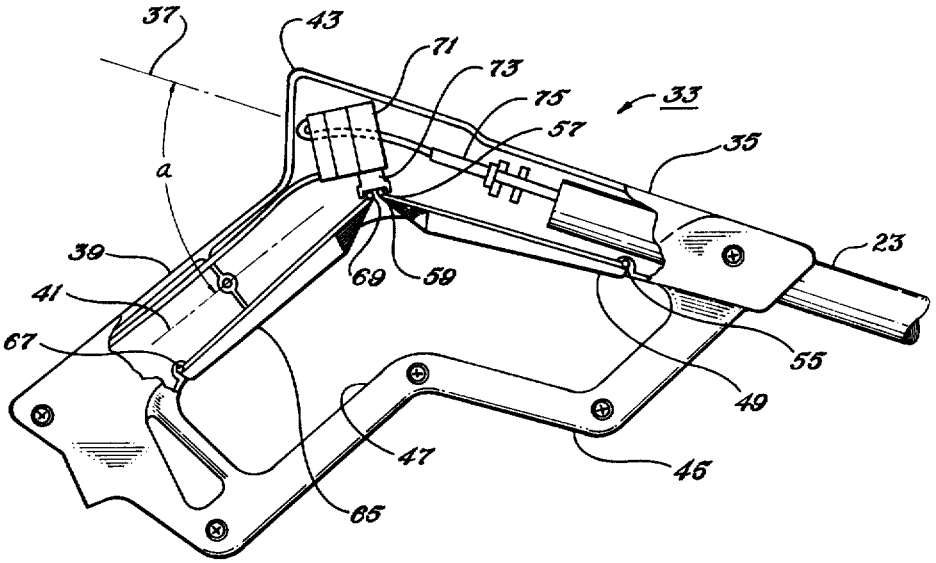
FIG. 2 is a partial, enlarged, side view of the upper handgrip of the snow removing device of FIG. 1, broken away to show internal components.

A molded plastic upper handgrip 33 is located on the upper and rearward end of handle 23. Referring to FIG. 2, upper handgrip 33 has a forward handgrip portion 35. In the preferred embodiment, forward handgrip portion 35 is a generally rectangular region for gripping by the operator. Forward handgrip portion 35 is in substantial alignment with handle 23. Preferably the longitudinal axis 37 of the forward handgrip portion 35 coincides with the axis of the handle 23. A rearward handgrip portion 39 depends downwardly from the forward handgrip portion 35. The rearward handgrip portion 39 is also generally in a rectangular configuration. Rearward handgrip portion 39 has an axis 41 that intersects the axis 37 of the forward handgrip portion 35 by an acute angle a, preferably about 60 degrees.

The forward handgrip portion 35 has an inner bore that receives the upper end of handle 23. The forward handgrip portion 35 is formed integrally with the rearward handgrip 39. A protuberance 43 extends rearwardly from the forward handgrip portion 35 at the intersection of the forward and rearward handgrips 35 and 39. Protuberance 43 helps retain wrapped electrical extension cord and aids in gripping when the snow thrower is used in the pushing mode. A finger guard 45 interconnects the lower side of the forward handgrip portion 35 at the front and the rearward handgrip portion 39 at the back. Finger guard 45 provides an aperture 47 through which the fingers of the operator may be inserted.

Figure 3:
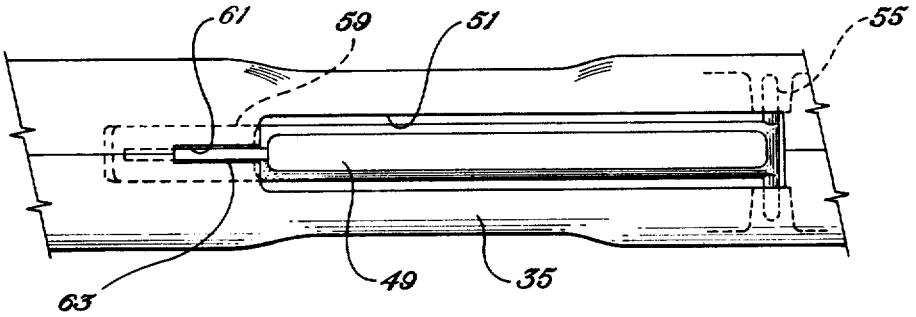
FIG. 3 is a bottom view of the forward trigger of the snow removing device of FIG. 1.

Upper handgrip 33 is hollow, and has a slot 51 (FIG. 3) on the lower side of forward handgrip portion 35. A forward trigger 49 is pivotally mounted to the lower side of the forward handgrip portion 35 by a pin 55 on its forward end. Trigger 49 is rectangular and elongated, with a movable rearward end 57 located inside upper handgrip 33 at the junction of the forward and rearward handgrip portions 35 and 39. Trigger 49 extends downward through slot 51, and is retained within handgrip 33 by a flange 59, as shown in FIG. 3. Flange 59 is located on the movable end 57 and is wider than the rearward end 61 of slot 51. A web 63 formed on trigger 49 below flange 59 extends through slot in end 61 to guide the trigger 49.

A rearward trigger 65 is pivotally mounted to the lower side of the rearward handgrip portion 39 by pivot pin 67 on its rearward end. Trigger 65 is rectangular and elongated, with a movable forward end 69 located inside upper handgrip 33 at the junction of the forward and rearward handgrip portions 35 and 39. Trigger 65 extends downwardly through a slot identical to slot 51, and is retained by a flange and web in the same manner as trigger 49. A single electrical switch 71 is mounted inside upper handgrip 33 above the movable ends 57 and 69 of triggers 49 and 65. Switch 71 has a spring biased finger 73 that is located directly above movable ends 57 and 69. An end 57 or 69 will contact and move finger 73 upwardly when the respective trigger is squeezed. Switch 71 is connected into a wire 75 that extends from the motor to an electrical receptacle (not shown) at the bottom of rearward handgrip 39. When extension cord 25 (FIG. 1) is connected to the receptacle, switch 71 will supply current to the motor when either trigger 49 or 65 is squeezed.

In operation, to use the device in the shovel position, as shown in FIG. 1, the operator uses one hand to grip the lower handgrip 27. The other hand grips the forward handgrip portion 35. The operator actuates the motor by selectively squeezing the forward trigger 49. In this position, the housing 13 can be easily lifted an swung forwardly to throw snow up over the edges of deep drifts of snow. The lower handgrip 27 will be a fulcrum point in the shovel mode. Pushing downwardly on the upper handgrip 33 causes the housing 13 to lift upwardly. The forward trigger 49 allows both hands to encircle the same axis for comfortable shovelling operation.

To use the device in the pushing and pulling mode (not shown), the operator places one hand on the rearward handgrip portion 39, then pushes and pulls the device with the housing 13 being in contact with the surface. The operator squeezes rearward trigger 65 to selectively activate the motor to rotate impeller 15 to remove snow. Normally the operator places his other hand on the intermediate handgrip 31. The rearward trigger 65 allows the operator's hand to encircle an axis transverse to the handle 23 axis for comfortable pushing movement.

The invention shown has significant advantages. The dual triggers and multiple handgrips enable the device to be easily used either in the shovel mode or in the pushing mode. The device is rugged, yet simple, and adds relatively little expense to conventional snow throwing devices.

While the invention has been only shown in one of its forms, it should be apparent to those skilled in the art that it is not so limited, but is susceptible to various changes and modifications without departing from the spirit of the invention.

I claim:

1. In a bulk material moving device of the type having a housing containing an electrical motor and an impeller driven by the motor, and a tubular handle extending upwardly and rearwardly from the housing, an improved means for operating and controlling the device, comprising:

a lower handgrip carried on the handle at the forward end joining the housing;

an upper handgrip mounted to the rearward end of the handle, the upper handgrip having a forward handgrip portion with an axis that coincides with the axis of the handle, and a rearward handgrip portion that extends downwardly from the forward handgrip portion;

an elongate forward trigger having a forward end pivotally mounted to the lower side of the forward handgrip portion and a movable end located within the upper handgrip at the junction of the forward and rearward handgrip portions;

an elongated rearward trigger having a rearward end pivotally mounted to the lower side of the rearward handgrip portion and a movable end located within the upper handgrip at the junction of the forward and rearward handgrip portions; and an electrical switch mounted inside the upper handgrip for contact with the movable ends of the triggers, the switch being electrically connected to the motor so that pivoting either trigger moves the switch to control the motor.

* * * * *